US005563636A

United States Patent [19]

Glassett et al.

[11] Patent Number: 5,563,636

[45] **Date of Patent: *Oct. 8, 1996**

[54] ON-LINE/OFF-LINE PRIMER FOR INK JET CARTRIDGE

[75] Inventors: Kevin L. Glassett, Escondido; Stephen W. Bauer, San Diego, both of Calif.

[73] Assignee: Hewlett-Packard Company, Palo Alto, Calif.

[ * ] Notice: The term of this patent shall not extend beyond the expiration date of Pat. No. 5,420,619.

[21] Appl. No.: 412,185

[22] Filed: Mar. 28, 1995

Related U.S. Application Data

[63] Continuation of Ser. No. 56,012, Apr. 30, 1993, Pat. No. 5,420,619, which is a continuation-in-part of Ser. No. 878, 959, May 4, 1992, abandoned.

[51] Int. Cl.[6] ..... B41J 2/165

[52] U.S. Cl. ..... 347/30; 347/32

[58] Field of Search ..... 347/22, 29, 30, 347/31, 32

[56] References Cited

U.S. PATENT DOCUMENTS

| | | | |
|---|---|---|---|
| 4,410,900 | 10/1983 | Terasawa | 346/140 R |
| 4,543,591 | 9/1985 | Terasawa | 346/140 R |
| 4,577,203 | 3/1986 | Kawamura | 346/140 R |
| 4,600,931 | 7/1986 | Terasawa | 346/140 R |
| 4,853,717 | 8/1989 | Harmon et al. | 346/140 R |
| 5,420,619 | 5/1995 | Glassett et al | 347/30 |

FOREIGN PATENT DOCUMENTS

| | | | |
|---|---|---|---|
| 0569155 | 11/1993 | European Pat. Off. . | |
| 2929742 | 2/1981 | Germany | 347/30 |
| 58-194568 | 11/1983 | Japan . | |
| 59-78858 | 5/1984 | Japan . | |
| 62-113556 | 5/1987 | Japan | 347/29 |
| 63-224957 | 9/1988 | Japan . | |

OTHER PUBLICATIONS

Patent Abstracts of Japan, vol. 16, No. 456 (M–1314) 22 Sep. 1992 & JP–A–04 161 343 (I. Takuro) 4 Jun. 1992.

*Primary Examiner*—John E. Barlow, Jr.

[57] ABSTRACT

Ink jet printhead primer apparatus including a resilient bellows having an upper end cap, a lower end cap, a capper having an opening supported by the upper end cap selective sealing engagement with a nozzle array of a printhead so that negative pressure produced in the opening of the upper end cap is communicated to the nozzles of the nozzle array, or with a conduit structure connected to the nozzles of the nozzle array. Displacement of the lower end cap is controlled by cam surfaces formed on the inner opposing surfaces of parallel plate-like gear sectors of a rotatable cam assembly having gear teeth that drive a flywheel. Cam edges on the gear sectors move a sliding cam member that moves the upper end cap between a retracted position and an extended position. Pursuant to rotation of the cam assembly in one direction and then in the opposite direction, negative pressure is produced at the capper opening as it is engaged with the nozzle array of the cartridge to be primed or with the conduit structure connected to the nozzle array, ink suctioning negative pressure is produced, and the capper is disengaged from the nozzle array or the conduit structure while negative pressure continues to be maintained at the opening of the capper.

5 Claims, 10 Drawing Sheets

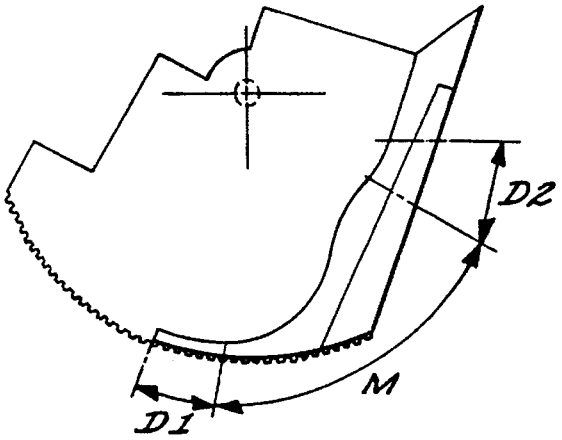
FIG. 6
FIG. 7
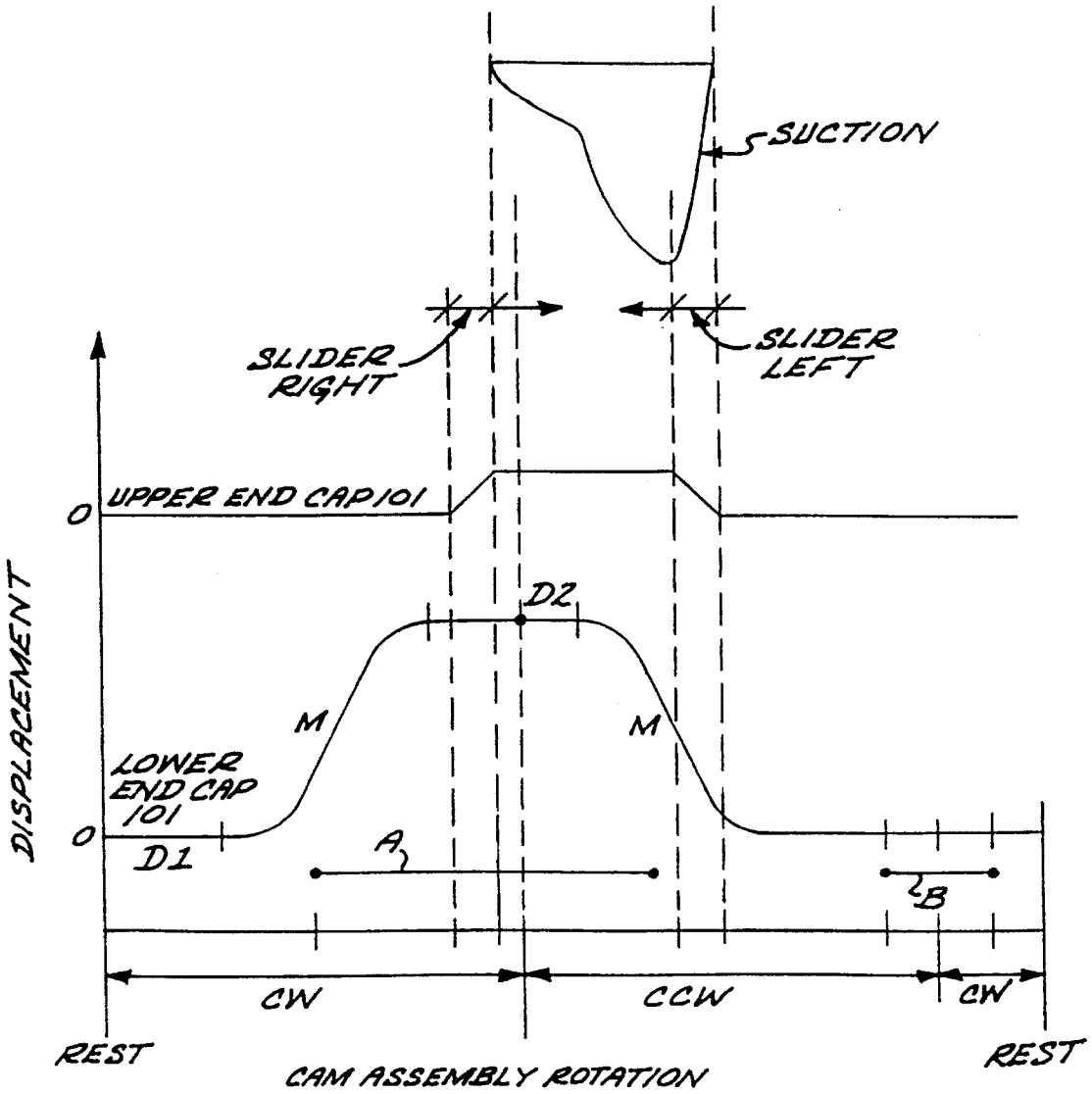

ON-LINE/OFF-LINE PRIMER FOR INK JET CARTRIDGE

This is a continuation of application Ser. No. 08/056,012 filed on Apr. 30, 1993 U.S. Pat. No. 5,420,615. Which is a continuation-in-part of commonly owned U.S. application Ser. No. 07/878,959, filed May 4, 1992, by Kevin L. Glassett, for "PRIMER APPARATUS FOR THERMAL INK-JET CARTRIDGE" abandoned.

BACKGROUND OF THE INVENTION

The subject invention generally relates to ink-jet printer technology, and is directed more particularly to apparatus for priming a thermal ink-jet printhead cartridge.

Thermal ink jet printers commonly utilize ink jet printhead cartridges which typically include one or more ink reservoirs and an integrated circuit printhead that includes a nozzle plate having an array of ink ejecting nozzles which emit ink droplets in response to electrical pulses provided to the printhead.

An important consideration with printhead cartridges is the need to ready a cartridge for printing. For example, when a new cartridge is installed in a printer or after a period of non-usage, the cartridge might be unable to produce ink drops at one or more nozzles, for example as a result of foreign contamination of the nozzles, dried ink in the nozzles, or air injected into the nozzles.

Known systems for priming include those which are involve the application of pressure to the ink supply in order to cause ink flow into the ink containing chambers that are adjacent the ink ejecting nozzles. Considerations with such known systems is need for access to the ink reservoir, and the various mechanical impedances between the ink reservoir and the nozzles which reduce the pressure that eventually reaches the nozzles.

SUMMARY OF THE INVENTION

It would therefore be an advantage to provide an ink jet cartridge primer that provides priming negative pressure directly to the nozzles of an ink jet cartridge.

The foregoing and other advantages are provided by the invention in a primer apparatus that includes an elongated resilient bellows assembly compressible along its length and having upper and lower end caps at its ends. The upper cap includes an opening at which negative pressure (i.e., lower that ambient atmospheric pressure) is produced when the upper and lower end caps are relatively displaced away from each other. A capper having an opening is supported by the first end cap of the bellows assembly for selective engagement with the nozzle array of the cartridge being primed or with a conduit structure that connected to the nozzle plate of the cartridge being primed, so that the negative pressure produced in the opening of the first end cap is communicated to the nozzles of the nozzle array. The displacement of the lower end cap is controlled by cam surfaces formed on the inner opposing surfaces of parallel plate-like gear sectors of a rotatable cam assembly which also includes cam edges for moving a sliding cam member that moves the upper end cap between a retracted position and an extended position, wherein movement of the upper end cap from the retracted position to the extended position is away from the lower end cap. Pursuant to rotation of the cam assembly in one direction and then in the opposite direction, negative pressure is produced at the capper opening as it is engaged with the nozzle plate of the cartridge to be primed or the conduit structure connected to the nozzle plate of the cartridge to be primed, ink suctioning negative pressure is then produced, and the capper is disengaged from the nozzle plate of the cartridge or the conduit structure while negative pressure continues to be maintained at the opening of the capper. In this manner, negative pressure is provided at the capper opening at all times that the capper is engaged against the nozzle plate, which avoids the application of positive or zero pressure by the capper to the cartridge nozzle array.

BRIEF DESCRIPTION OF THE DRAWINGS

The advantages and features of the disclosed invention will readily be appreciated by persons skilled in the art from the following detailed description when read in conjunction with the drawing wherein:

FIG. 6 is a schematic elevational view of the profile of certain cam surfaces in a cam assembly of the primer of FIG. 1 which control the displacement of the lower end cap of the bellows of FIG. 3.

FIG. 7 schematically depicts the various displacements of components of the primer of FIG. 1 during the operation thereof.

DETAILED DESCRIPTION OF THE DISCLOSURE

Figure 1:
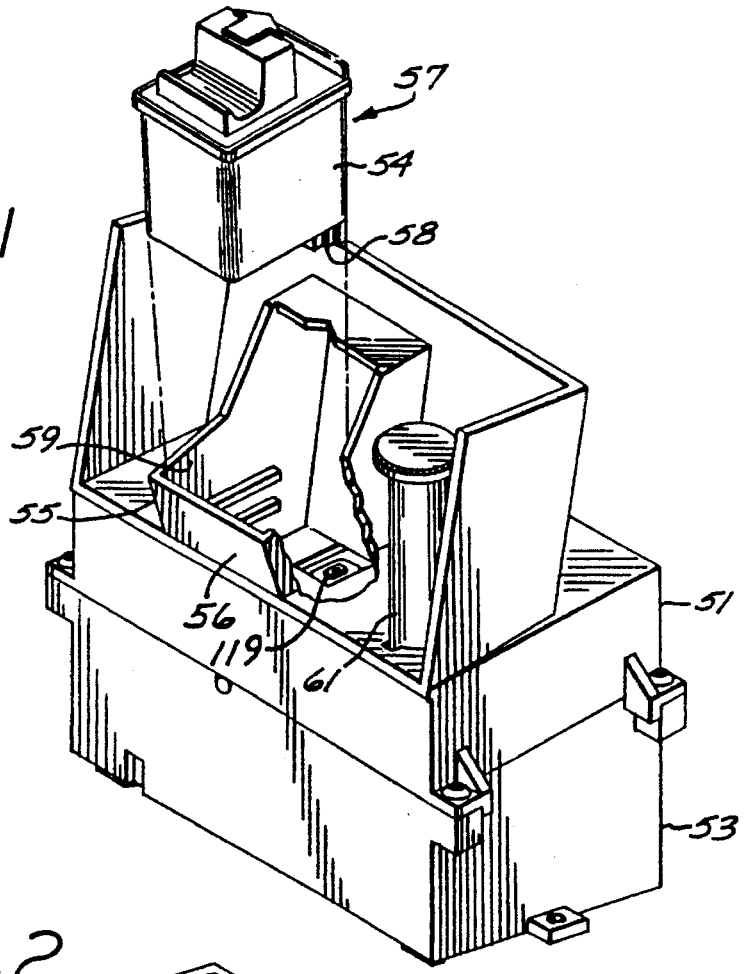
FIG. 1 is a perspective partial cutaway view of the exterior of an off-line ink jet cartridge primer in accordance with the invention for priming an ink jet printhead cartridge that is removed from a printer carriage and manually inserted into the primer.

In the following detailed description and in the several figures of the drawing, like elements are identified with like reference numerals.

Figure 2:
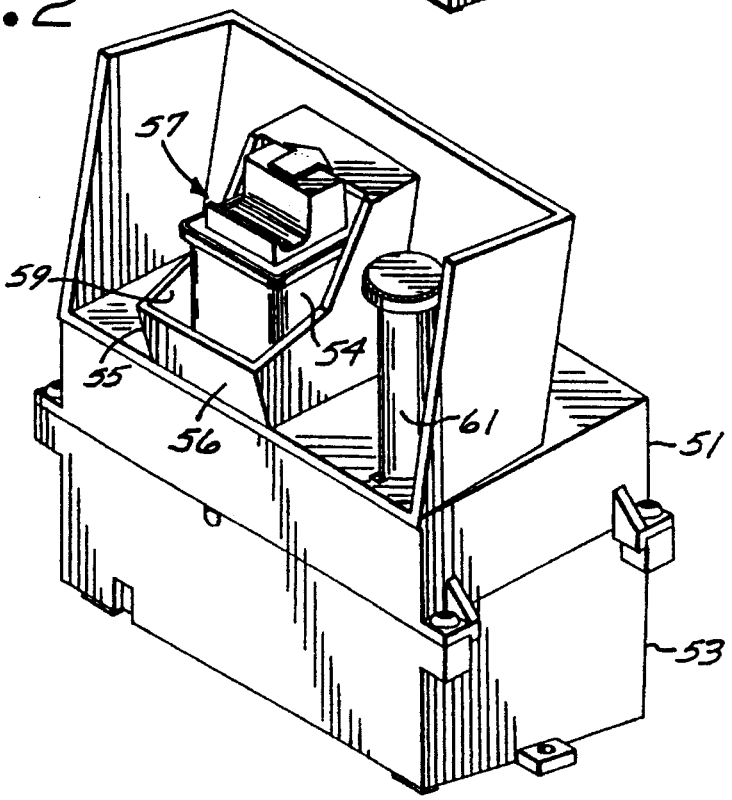
FIG. 2 is a perspective view of the exterior of the ink jet cartridge primer of FIG. 1 having a printhead cartridge installed therein for priming.

Referring now to FIGS. 1 and 2, set forth therein are schematic perspective views of an off-line ink-jet cartridge primer in accordance with the invention which primes an ink jet cartridge 57 which is removed from a printer carriage and inserted into the primer. The primer includes an upper housing 51 and a base housing 53 which are secured to each other. The upper housing 53 includes a chute 55 for accepting the ink jet cartridge 57 which includes a downwardly facing nozzle plate 58 that contains an array of ink jet nozzles. In accordance with known designs, the ink jet cartridge includes an ink reservoir 54 for containing ink which is appropriately fed to ink firing chambers (not shown) located adjacent to the nozzles of the nozzle array.

The chute 55 includes a front wall 56, side walls 59, a top wall offset rearwardly from the front wall 56, as well as appropriate stops and a clip for retaining the cartridge 57 in a fixed position. The chute 55 is configured to retain the cartridge 57 with the nozzle array of the nozzle plate in alignment with the opening in a capper 119 that is supported within the primer and is located in an opening in the top wall of the upper housing 51. The capper 119 comprises a resilient material such as rubber and the opening thereof includes a raised rim that is capable of surrounding the nozzle array of nozzle plate 58 and forming a seal therewith. As discussed more fully herein, when the cartridge 57 is secured in the chute 55, a plunger 61 is manually depressed to perform the priming procedure by which negative pressure (i.e., lower than ambient atmospheric pressure) is produced at the opening of the capper 119 as it is raised against the cartridge nozzle plate. The capper 119 remains engaged against the nozzle plate 58 while the negative pressure at the capper opening is made more negative, which draws ink into the nozzles of the nozzle array. While negative pressure continues to be present at the opening of the capper, the capper is retracted from the nozzle. In this manner, negative pressure is continuously present at the opening of the capper 119 from the time it is engaged with the nozzle plate 58 until the time it is disengaged from the nozzle plate 58, whereby neither positive nor zero pressure is ever applied by the capper to the nozzle array of the cartridge 57.

Figure 3:
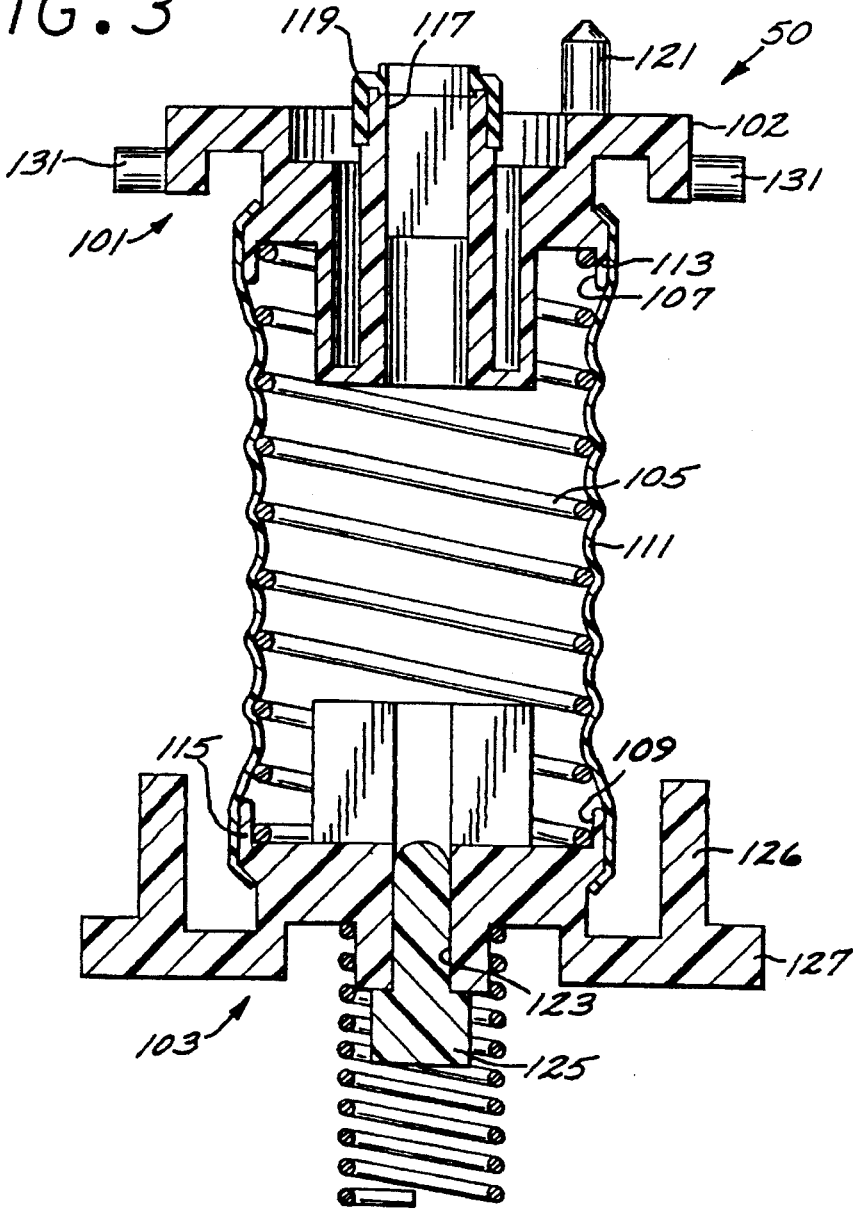
FIG. 3 is a schematic elevational sectional view illustrating the bellows assembly of the primer of FIG. 1.
Figure 5:
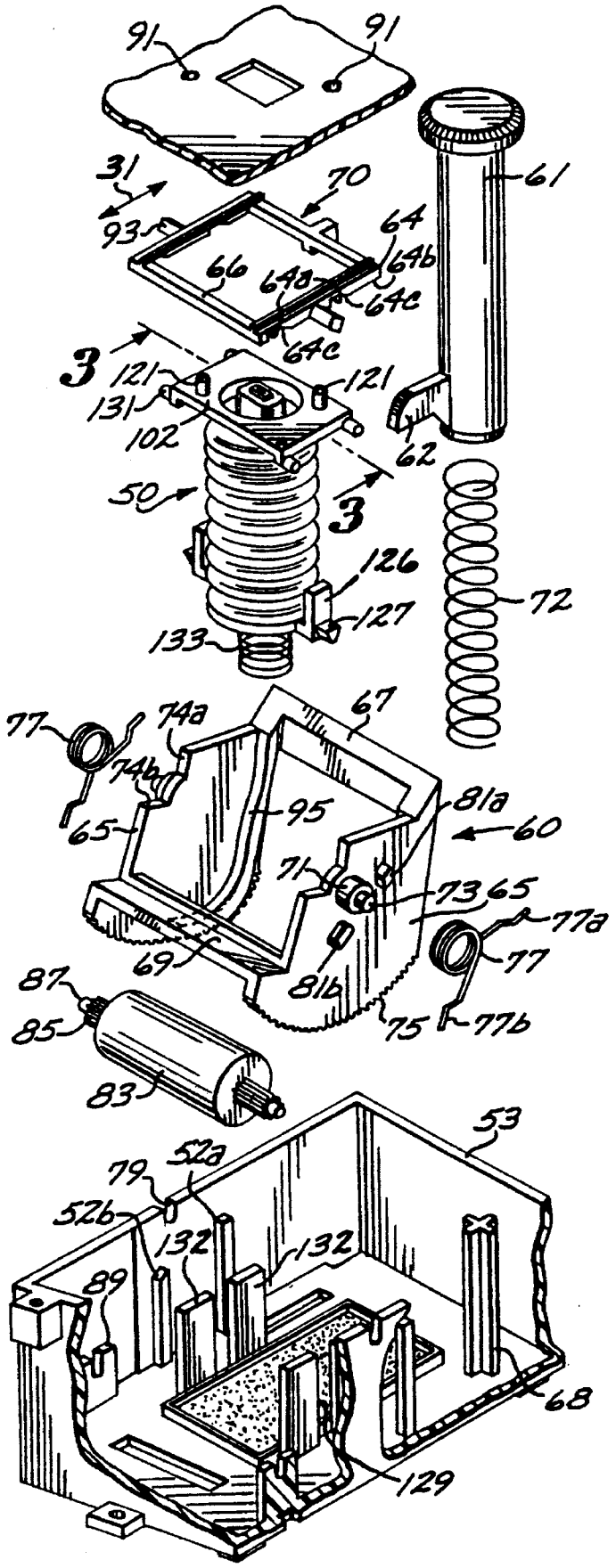
FIG. 5 is a perspective exploded view of the components of the primer of FIG. 1.

Referring now to FIG. 3, set forth therein is a schematic sectional view of a bellows assembly 50 which supports the capper 119 and is contained in the primer, as discussed further herein relative to FIG. 5. The bellows assembly 50 includes upper and lower end caps 101, 103, and an internal spring 105 having ends engaged in retaining recesses 107, 109 in the end caps 101, 103. A flexible, pliable sleeve 111 snugly surrounds the spring 105 and has its ends securely engaged around annular convex beads 113, 115 formed in the proximal portions of the end caps 101, 103. The sleeve 111 is configured such that the internal spring 105 is slightly compressed when the bellows is fully expanded, whereby the length of the uncompressed bellows assembly is determined by the sleeve 111.

Figure 4:
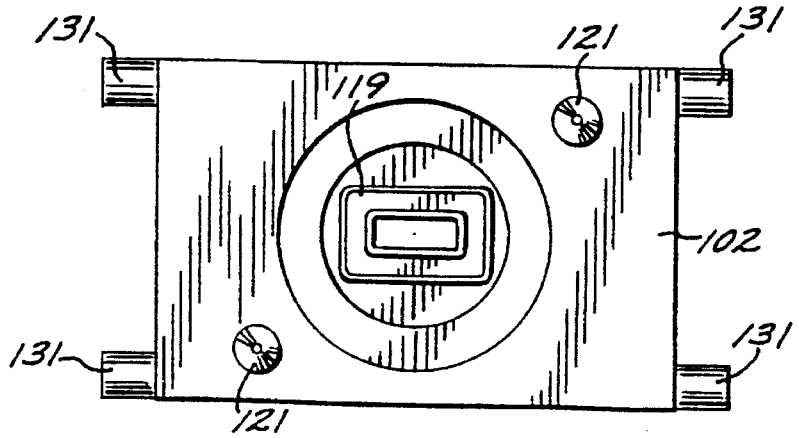
FIG. 4 is a top plan view of the upper end cap of the bellows assembly of FIG. 3.

The upper end cap 101 (further shown in top plan view in FIG. 4) includes an axially oriented projection 117 having an opening that extends into the inside volume of the bellows assembly, and the capper 119 is fitted over the end of the projection 117 with its opening in communication with the opening of the projection 117. A top plate 102 surrounds the projection 117, and is separated therefrom by an intervening recess. The upper end cap 101 further includes pins 121 aligned with the longitudinal extent of the bellows assembly and located at diametrically opposite locations. As described further herein in conjunction with FIG. 5, the pins 121 are slidably engaged in corresponding openings 91 in the top wall of the upper housing 51, and allow for movement of the upper end cap 101 along the longitudinal extent of the bellows assembly. Such movement is imparted to the upper end cap 101 by movement of laterally extending cam follower pegs 131 which are downwardly offset relative to the top plate so as to be lower than the peripheral edges of the top plate.

The lower end cap 103 includes a centrally located bore 123 for retaining an ink permeable plug 125 that is sufficiently impermeable to air to allow the bellows assembly 50 to produce negative pressure at the opening of the capper 119 pursuant to expansion of the bellows assembly. The lower end cap 103 further includes diametrically opposite L-shaped guides 126, each having a radially extending section and an upwardly extending section. Cam follower pegs 127 extend radially from the guides 126.

When installed in the primer, the bellows assembly 50 is compressed and expanded by controllably moving the upper end cap 101 and the lower end cap 103 relative to each other. In particular, the end caps 101, 103 are constrained to be movable only along the longitudinal extent of the bellows assembly 50, and the cam follower pegs 131 of the upper end cap 101 and the cam follower pegs 127 of the lower end cap 103 are engaged against respective cam surfaces that control the movement of the end caps along the longitudinal extent of the bellows assembly. By way of illustrative implementation, cam surfaces for the cam follower pegs 131 of the upper end cap 101 engage the top portion of the pegs while the cam surfaces for the cam follower pegs 127 of the lower end cap 103 engage the bottom portion of the pegs, and the bellows assembly 50 is of sufficient length such that it is partially compressed when it is at its maximum expansion as allowed by the cam surfaces. In this manner, the cam follower pegs 127, 131 are continuously providing an expanding bias against their associated cam surfaces.

Referring now to FIG. 5, set forth therein is an exploded perspective view of components of the primer that cooperate with the bellows assembly 50 to achieve the application of priming negative pressure to the nozzle array of the cartridge 57. The L-shaped guides 126 of the bellows assembly are slidably engaged in vertical slots 129 formed by the adjacent edges of vertically extending guide members 132 attached to the bottom of the base housing 53, while the pegs 121 of the bellows assembly upper end cap 101 are slidably engaged in apertures 91 in the top wall of the upper housing 51 which are located such that the upper and lower end caps 101, 103 are aligned with each other along the longitudinal extent of the bellows assembly 50, and the displacement of the end caps 101, 103 will be along the longitudinal extent of the bellows assembly 50.

The vertical position of the upper end cap 101 is controlled by engagement of the cam follower pegs 131 against cam surfaces on the bottom of parallel cam members 64 of a rectangular slider 70 that surrounds the top plate 102 of the upper end cap 101. The parallel cam member 64 are positioned tangentially to corresponding edges of the upper end cap top plate 102 adjacent, and are fixed relative to each other by parallel support members 66 located between the ends of the parallel cam members 64. The parallel cam members 64 are slidably biased against the inside surface of the top wall of the upper housing 51 by the cam follower pegs 131 of the upper end cap 101. Pursuant to the position of the cam members 64 relative to the top plate 102, the movement of the slider 70 is constrained to be along the cam members 64 as indicated by the double arrow 31 in FIG. 5. Actuating pegs 93 extend laterally from the parallel cam members 64 and are engaged to move the slider 70 along the axis 65, as described more fully herein.

The vertical position of the lower end cap 103 is controlled by engagement of the cam follower pegs 127 against cam surfaces 95 formed on the inner opposing surfaces of parallel plate-like gear sectors 65 of a rotatable cam assembly 60. A helper spring 133 is located between the lower end cap 103 and an ink absorbing pad located at the bottom of the base housing 53 provide an upward bias on the lower end cap that facilitates the upward movement of the lower end cap 103 pursuant to movement of the cam surfaces 95 against the cam follower pegs 127 of the lower end cap. The gear sectors 65 of the cam assembly 60 are fixed to each other by cross members 67, 69, and the cam surfaces 95 on their inside surfaces are mirror images of each other. A cylindrical spacer 71 and a spindle 73 are located on each gear sector 65 with both spacers and both spindles being coaxial on the line formed by the axial centers of gear sections 75 of each gear sector. Torsional coiled wire springs 77 are positioned around the cylindrical spacers 71 with the ends 77*a*, 77*b* of each wire forming a spring extending beyond positioning stops 81*a*, 81*b* formed on the gear sectors at appropriate locations. The spindles 73 are rotatably supported in slots 79 formed in the upper edges of the front and rear walls of the base housing 53. Rotation of the cam assembly 60 in conjunction with the downward bias of the lower end cap 103 and the upward bias of the helper spring causes the lower end cap 103 to move up and down along the slots 129. The upwardly extending portions of the L-shaped guides 126 prevent the rotation of the guides 126 as they move up an down in the vertical slots 129, thereby maintaining the orientation of the lower end cap as it moves up an down in the slots 129.

The gear sectors of the cam assembly 60 further include slider engaging edges 74*a*, 74*b* formed in the gear sectors at locations opposite the gear teeth. The engaging edges 74*a*, 74*b* are configured to move the slider 70 by engagement with the actuating pegs 93 of the slider at appropriate positions in the rotations of the cam assembly 60.

Referring now to FIG. 6, schematically illustrated therein is the profile of each of the cam surfaces 95. The profile includes a lower dwell section D1 that defines the lowest vertical position for the lower end cap 103, a vertical movement section M, and an upper dwell section D2 that defines the highest position for the lower end cap 103. The lower dwell section D1 and the upper dwell section D2 are of respective constant radii relative to the spindle axis, wherein the radius of the lower dwell section D1 is greater than the radius of the upper dwell section D2. The points of the vertical movement section M are at different distances from the spindle axis with such distance decreasing from the radius of the lower dwell section at the end of the vertical displacement section closest to the lower dwell section D1 to the radius of the upper dwell section at the end of the vertical movement section M closest to the upper dwell section D2.

The gear sectors 65 of the cam assembly 60 include gear teeth 75 which are engaged with pinion gears 85 located on either side of a cylindrical flywheel 83 and coaxial therewith. Spindles 87 outboard of the pinion gears are slidably engaged in slots of flywheel supporting members 89 formed on the inside of the front and rear walls of the base support 53. Thus, the flywheel rotates with the rotation of the cam assembly 60.

For reference, clockwise rotation of the cam assembly will refer to rotation of the cam assembly which moves the support member 67 toward the cam follower pegs 127 of the lower end cap 103, which is consistent with the perspective view of FIG. 5, the cam profile of FIG. 6, and the elevational sectional views of FIGS. 8–17.

The operation as well as further details of the primer will now be discussed in conjunction with FIGS. 7–17 wherein FIG. 7 schematically depicts, relative to the clockwise (CW) and counterclockwise (CCW) rotation of the cam assembly 60, the displacements of the upper end cap 101, the lower end cap 103, and the slider 70; the cam assembly rotation interval during which the spring ends 77*a* are tensioned; the cam assembly rotation interval during which one of the spring ends 77*b* is tensioned; and the negative pressure (suction) at the opening of the capper 119.

Figure 8:
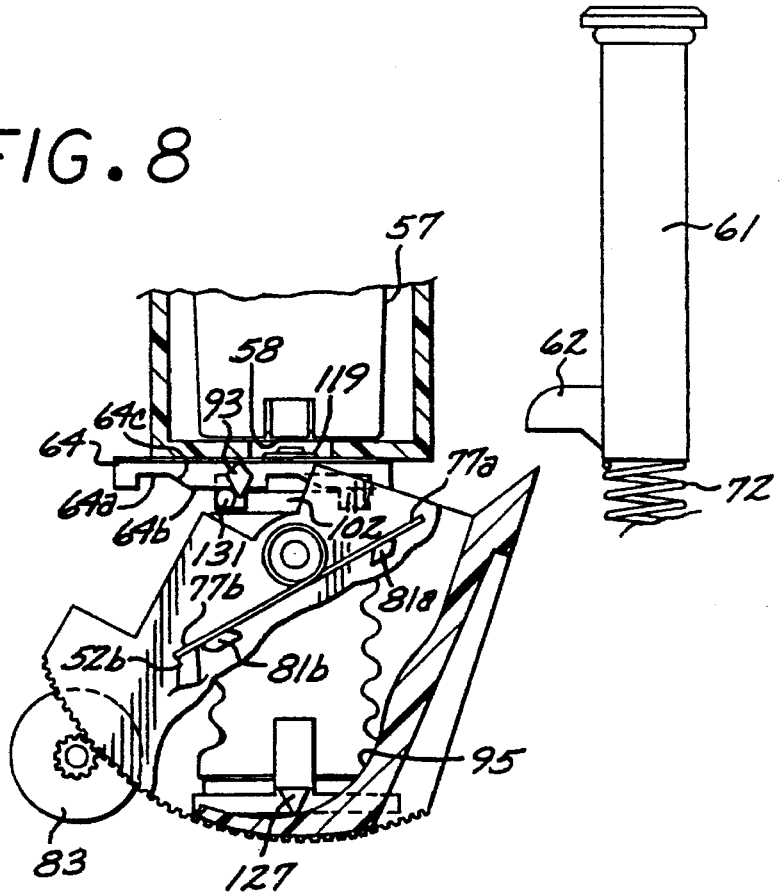
FIGS. 8, 9, 10, 11, 12, 13, 14, 15, 16, and 17 are schematic elevational sectional view illustrating the operation of the components of the primer of FIG. 1.

FIG. 8 illustrates the cam assembly 60 in its resting angular position that is defined by the lower dwell section D1 of the cam surfaces 95 and a stop 52*b* located on the inside surface of the rear wall of the base housing 53 and engageable by the spring end 77*b* of the spring 77 adjacent such rear wall. In particular, the resting angular position is defined by locating the stop 52*b* such that spring end 77*b* rests in a non-tensioned manner on the stop 52*b* when the cam assembly is angularly positioned with a portion of the dwell section D1 close to the vertical displacement section M engaged with the cam follower pegs 127. If the cam assembly 60 is rotated in the counter-clockwise direction from the angular resting position, the spring end 77*b* will be tensioned which will cause the cam assembly 60 to rotate clockwise to its angular resting position when the rotation causing force is removed. If the cam assembly 60 is rotated clockwise away from its angular resting position, the lower end cap 103 is raised by engagement of the vertical movement section M of the cam surfaces 95 with the cam follower pegs 127, and the downward bias of the cam follower pegs 127 will tend to rotate the cam assembly 60 counterclockwise to its angular resting position when the rotation cause force is removed.

In FIG. 8, the slider 70 is shown in the leftmost position as appropriate for the start of the priming operation, and in which it will be placed at the end of a priming operation as described further herein. The slider 70 is readily initialized to the leftmost position by depressing the plunger without a cartridge in the cartridge chute.

The cam assembly 60 is configured such that the support member 67 is at its highest position when the cam assembly is at its angular resting position as shown in FIG. 8. The support member 67 is engageable by an actuating tab 62 of the plunger 61 pursuant to depression of the plunger 61 which extends through an opening in the top wall of the upper housing 51 and travels along a guide rod 68 secured to the bottom of the base housing 53. A coil spring 72 provides expanding bias that restores the plunger to a raised position when it is released after being depressed. The top of the actuating tab 62 can be utilized to limit the upward travel of the plunger 61 by engagement with the inside surface of the top wall of the upper housing 51.

Figure 9:
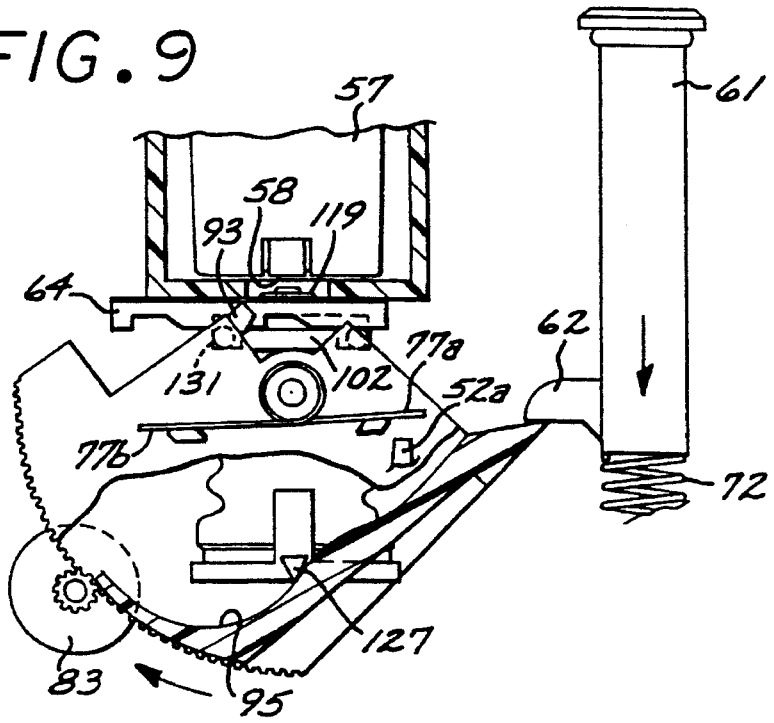

Depression of the plunger 61 with the actuating tab 62 engaged on the top of the support member 67 causes the cam assembly 60 to rotate in the clockwise direction. As the cam assembly rotates, the vertical movement section M of the cam surfaces 95 causes the lower end cap 103 to move upwardly, thereby compressing the bellows assembly 50, and the cam edges 77*b* eventually engage the cam follower pegs 93 of the slider 70, as shown in FIG. 9. The movement of the slider to the right eventually slides the angled cam surfaces 64*c* of the slider 70 into engagement with the cam follower pegs 131 of the upper end cap, which then causes the slider 70 to snap to the right pursuant to upward bias exerted by the cam follower pegs 131 against the angled ramp surfaces 64*c*, which allows the upper end cap 101 of the bellows assembly to move upwardly as the angled cam surfaces 64*c* and then the recessed cam surfaces 64*a* of the cam members 64 slide against the cam follower pegs 131. The slider 70 and the cam surfaces 95 are configured such that only the upper dwell section D1 is sliding against the cam follower pegs 127 of the lower end cap 103 when the upper end cap 101 moves upwardly to engage the capper 119 against the nozzle plate 58. In this manner, the lower end cap 103 is stationary while the upper end cap 101 moves upwardly, which produces negative pressure at the opening of the capper 119 as it seals against the nozzle plate 58.

Figure 10:
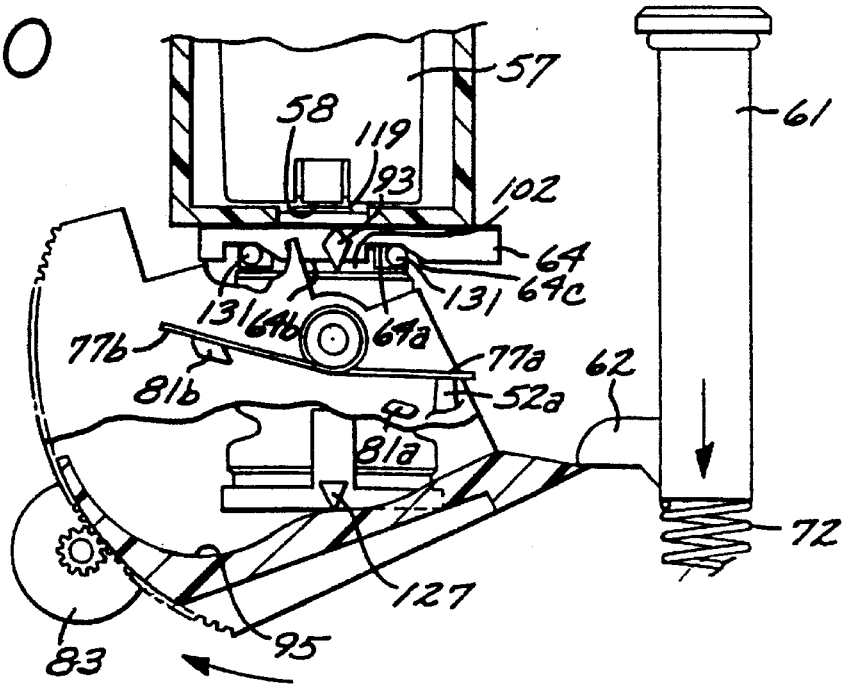

As the cam assembly 60 continues to rotate clockwise pursuant to continued depression of the plunger 61, the spring ends 77*a* engage stops 52*a* located on the front and rear walls of the lower base 53, as shown in FIG. 10, which also shows the slider 70 fully to the right as a result of the sliding force imparted on the angled surfaces 64*c* by the upward bias of the cam follower pegs 131 of the upper end cap. Pursuant to such engagement, the spring 77 is tensioned as the cam assembly 60 continues to be rotated clockwise by the downward movement of the plunger 61. The engagement of the spring ends 77*a* against the stops 52*a* is represented in FIG. 7 by the line A.

Figure 11:
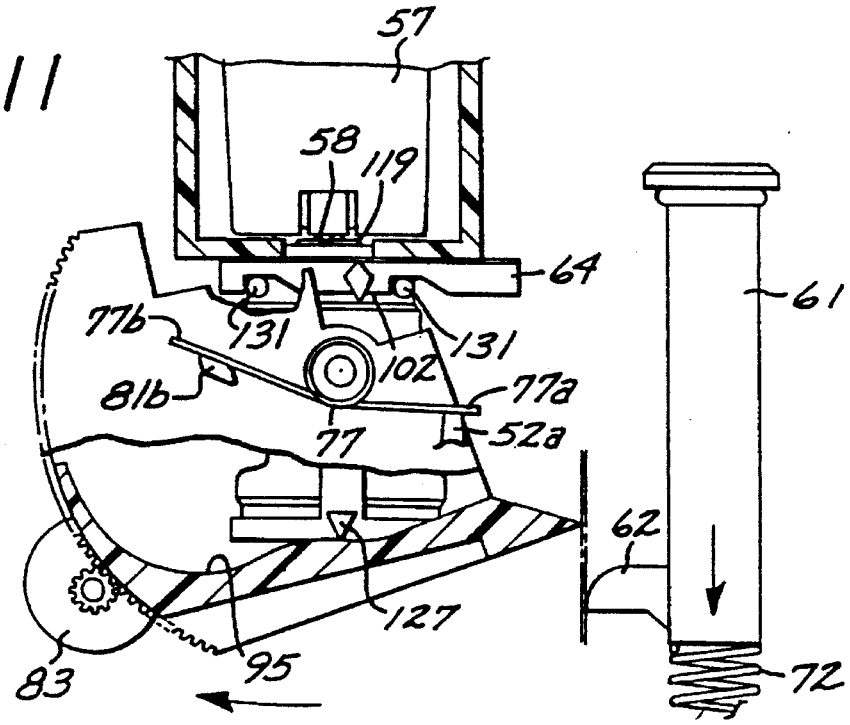

As the cam assembly rotates clockwise, the support member 67 moves further away from the plunger by virtue of the circular path it is following, and the actuating tab 62 eventually bypasses the support member 67, as shown in FIG. 11. After the support member 67 is free of the actuating tab 62, the cam assembly slows and then begins rotating in the counterclockwise direction pursuant to the tension of the springs 77. At the beginning portion of the counter-clockwise rotation, the pressure at the opening of the capper does not change by virtue of the upper dwell section D2 of the cam surfaces 95. With continuation of the counterclockwise rotation, the lower end cap 103 moves downwardly by virtue of the vertical displacement section M of the cam surfaces 95, whereby the bellows assembly 50 expands to make the pressure at the opening of the capper more negative than the initial negative pressure produced upon engagement of the capper against the nozzle plate 58, which causes ink to be suctioned out of the nozzles of the nozzle plate 58. As a result of the inertia of the flywheel 83, the rotation of the cam assembly 60 is slowed, whereby the ink suctioning negative pressure is applied over a longer time interval than would be provided if the cam assembly 60 were rotated without the flywheel 83.

Figure 12:
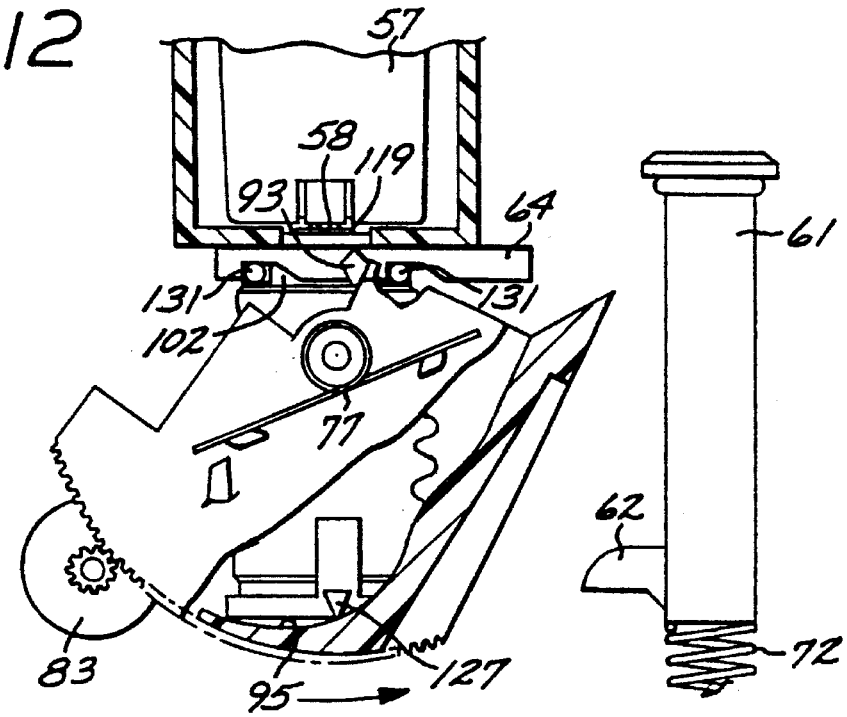
Figure 13:
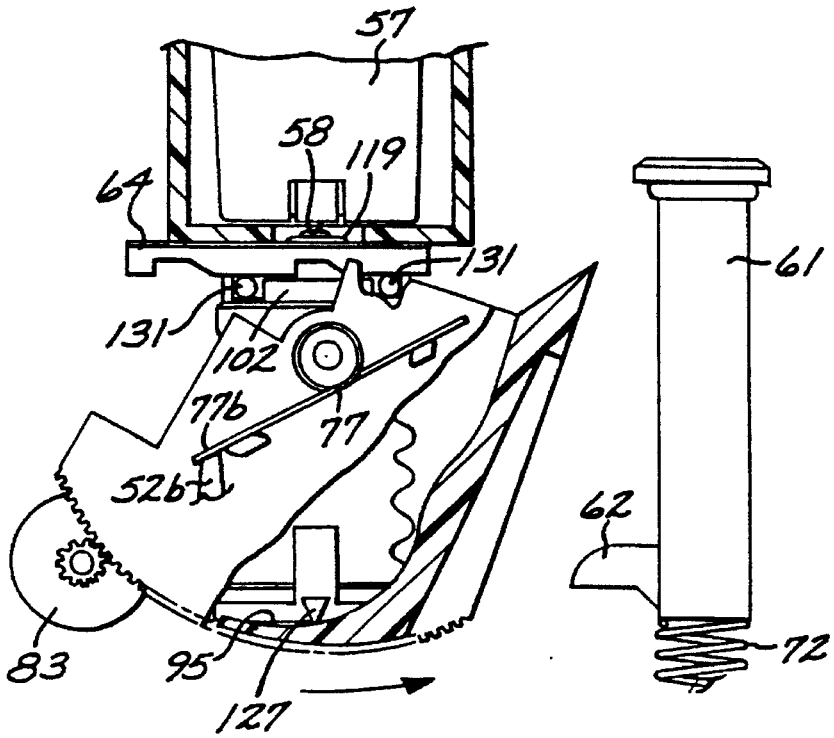

As the cam assembly 60 continues its counterclockwise rotation, the spring ends 77*a* eventually become disengaged from the stops 52*a*, but the cam assembly 60 continues to rotate counterclockwise pursuant to the rotational momentum of the flywheel 83. Prior to reaching its resting angular position, the cam edges 74*a* engage the cam follower pegs 95 of the slider and move the slider 70 to the left with the counterclockwise rotation, which causes the angled surfaces 64*c* and then the non-recessed surfaces of the cam numbers 64 to slide over the cam follower pegs 131, thereby causing the upper end cap to be moved downwardly, as shown in FIGS. 12 and 13. The slider 70, the cam edges 74*a*, and the cam surfaces 95 are configured such that while the upper end cap 101 is moving downwardly, the lower end cap 103 moves downwardly at a greater rate than the rate of the downward movement of the upper cap, whereby negative pressure is present at the opening of the capper as it is being disengaged from the nozzle plate of the cartridge. The negative pressure during disengagement of the capper from the nozzle plate 58 can be less than the ink suctioning negative pressure.

Figure 14:
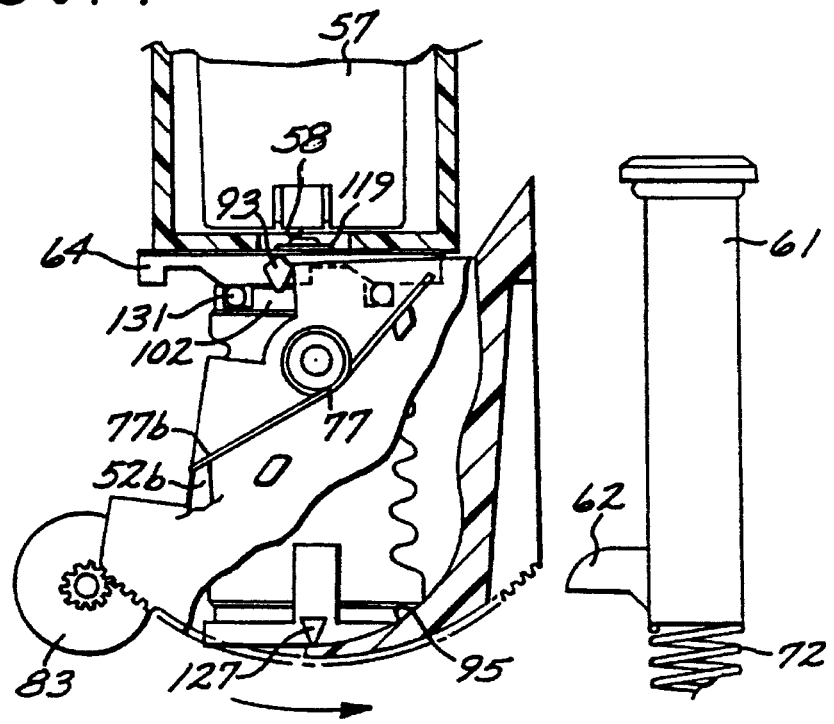
Figure 15:
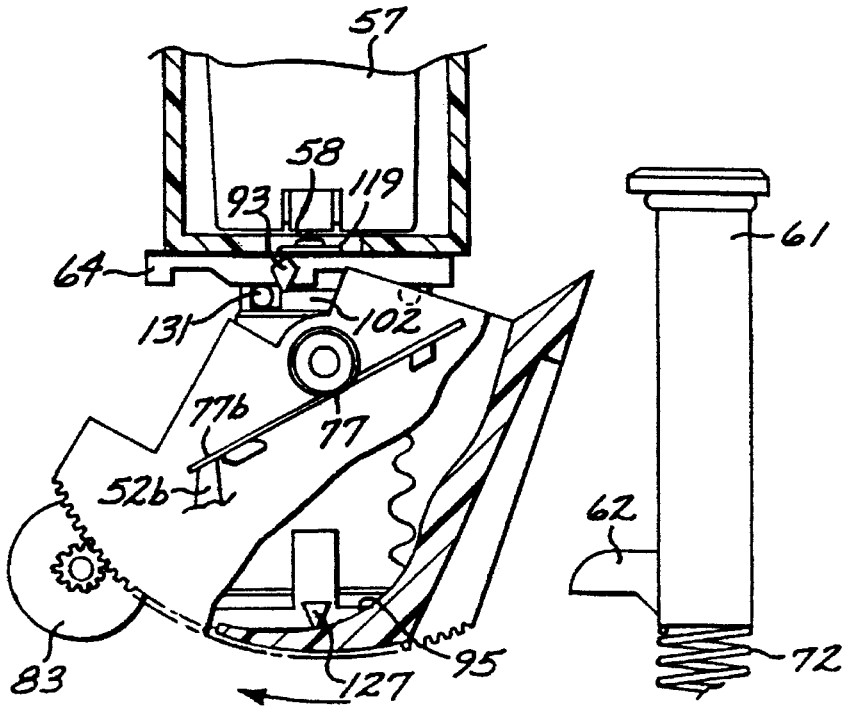

By virtue of the momentum of the flywheel as well as its own momentum, the cam assembly continues to rotate in the counterclockwise direction past its resting angular position until the spring end 77*b* engages the stop 52, as shown in FIG. 14. This causes the cam assembly 60 to stop its counterclockwise rotation and then rotate clockwise to its resting angular position, as shown in FIG. 15, which insures that the support member 67 is in the path of the actuating tab 62 and therefore ready for the next priming operation. The engagement of the spring end 77*b* against the stop 52*b* is represented in FIG. 7 by the line B.

Figure 16:
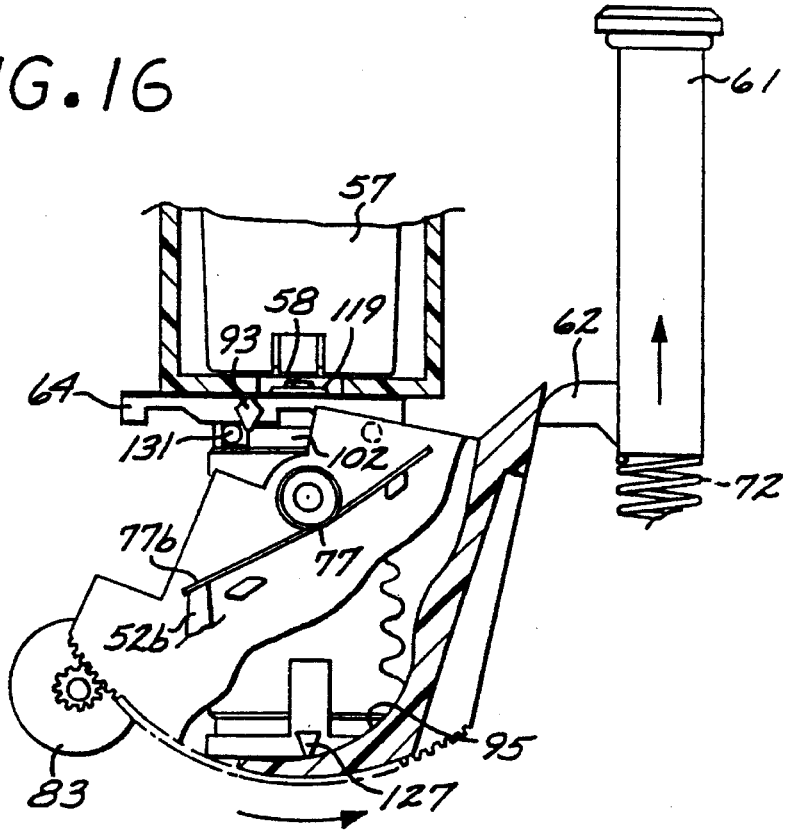
Figure 17:
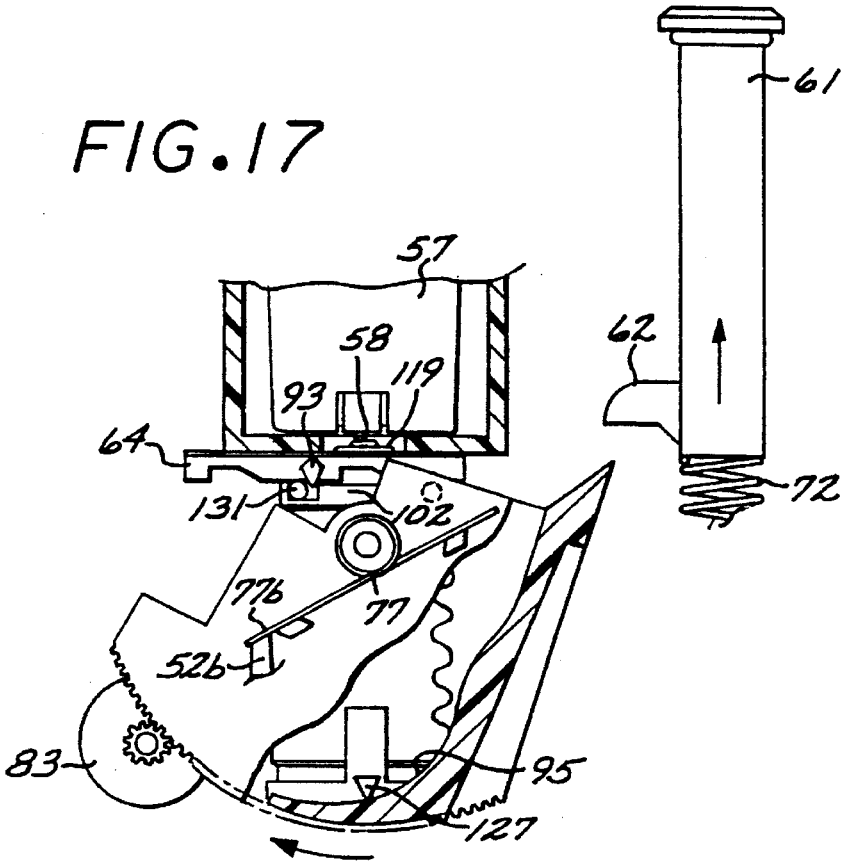

Release of the pressure on the plunger 61 allows it to move upwardly pursuant to the upward bias of the spring 72. The top edge of the actuating tab 62 eventually contacts the support member and causes the cam assembly to the rotate counterclockwise, which tensions the spring end 77*b* against the stop 52*b*, as shown in FIG. 16. When the actuating tab 62 clears the support member 67, the tension of the spring 77 causes the cam assembly to rotate clockwise to its resting angular position, as shown in FIG. 17, while the plunger continues in its upward travel.

Figure 18:
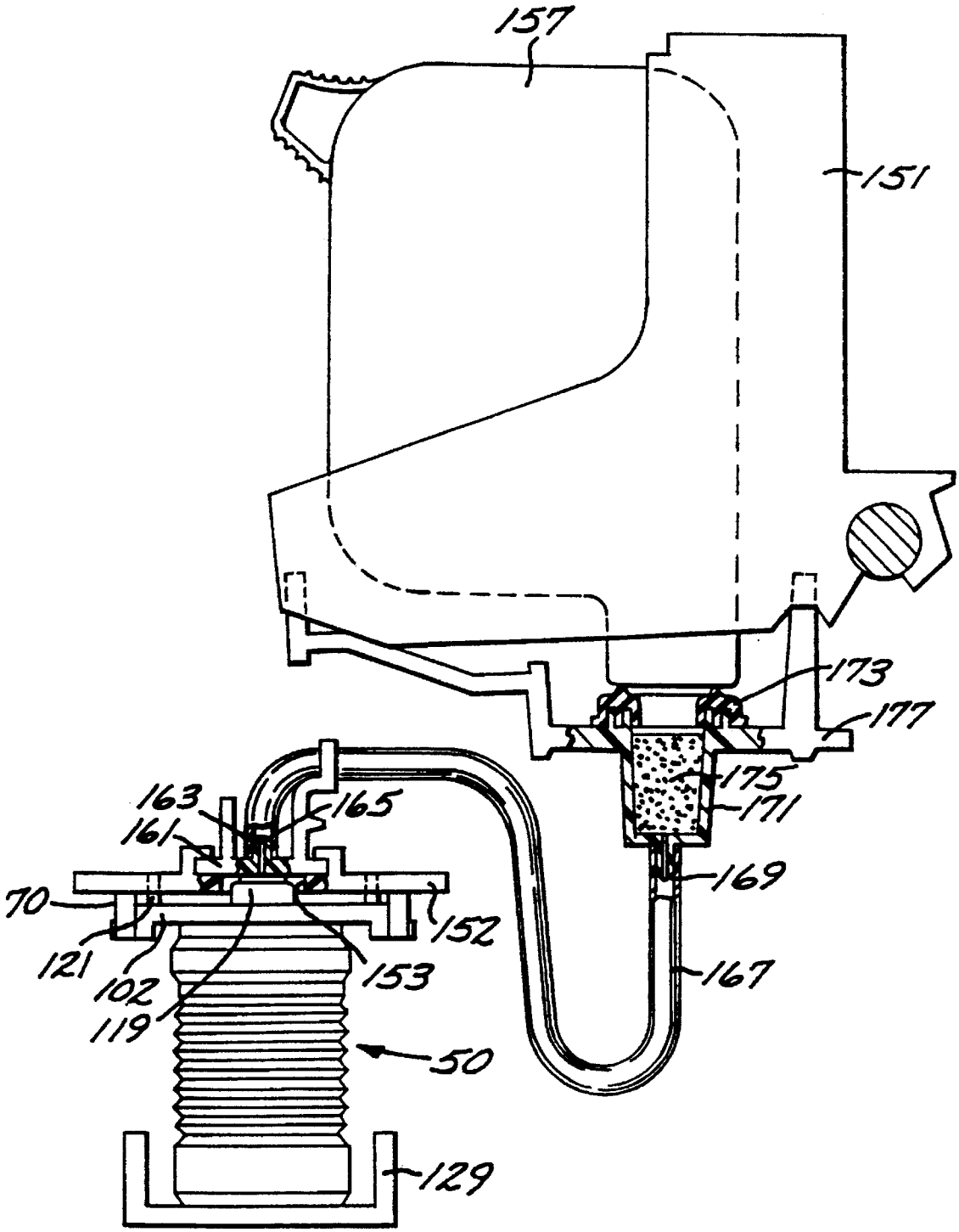
FIG. 18 is a schematic sectional view illustrating an on-line ink jet cartridge primer for priming a cartridge that is operationally secured in a printer carriage and is primed without removal from the printer carriage.

Referring now to FIG. 18, set forth therein is an elevational sectional view of an implementation of an on-line primer apparatus in accordance with the invention that provides priming vacuum to an ink jet cartridge 157 that is operationally secured in a print carriage 151 and does not need to be removed for priming. The primer apparatus of FIG. 18 is similar to the primer of FIG. 1, except that a flat panel 152 is disposed over the slider 70. The top panel 152 includes an opening 153 similar to the opening in the upper housing 51 of the primer of FIG. 1, and also includes apertures (not shown) for accommodating the guide pins 121 of the upper end cap 101. A connector plate 161 that includes an upwardly extending fitting 163 and a bore 165 that extends through the plate 161 and the fitting 163 is disposed over the top panel 151. The bore and fitting are located such that the opening in the capper 119 surrounds the terminal portion of the bore 165 at the bottom of the connector plate 161 when the capper 119 engages the bottom of the connector plate 161 pursuant to actuation of a plunger as described earlier relative to the primer of FIG. 1. The connector plate 161 is vertically constrained by retaining fingers that extend upwardly from the connector plate such that the capper 119 presses tightly against the bottom of the connector plate when it engages the connector plate 161.

The fitting 163 of the connector plate 161 is connected by a flexible tube 167 to a lower port 169 of a chamber 171 having a cap 173 disposed over a top opening thereof. By way of illustrative example, the chamber 171 is supported by a sled 177 that forms part of a printer service station that is located to one side of the print area of the printer and provides functions such as capping and wiping of the nozzle array of the ink jet cartridge 157. In particular, the cartridge 157 is capped pursuant to the upward movement of the sled 177 toward the cartridge 157 such that the cap 173 is engaged against the nozzle plate of the cartridge 157 and surrounds the nozzle array thereof. The chamber 171 contains for example an ink trapping filter 175 that prevents ink clogging of the flexible tube 167.

Examples of printer service stations are disclosed in commonly assigned U.S. Pat. No. 4,853,717, which is incorporated herein by reference; in commonly assigned copending U.S. application Ser. No. 08/056,327, filed Apr. 30, 1993, by Heinz Waschhauser and William Osborne for "SERVICE STATION HAVING REDUCED NOISE, INCREASED EASE OF ASSEMBLY AND VARIABLE WIPING CAPABILITY", Attorney Docket No. 1093129-1, which is incorporated herein by reference; and in commonly assigned copending U.S. application Ser. No. 07/949,197, filed Sep. 21, 1992, by William S. Osborne for "INK-JET PRINTHEAD CAPPING AND WIPING METHOD AND APPARATUS", Attorney Docket No. 1092206-1, which is incorporated herein by reference.

In the priming apparatus of FIG. 18, the priming negative pressure produced at the opening of the capper 119 is communicated to the on line cartridge via the bore 165, the flexible tube 167, and the chamber 171. The capper 119 is separated from the connector plate except when negative pressure is present at the opening of the capper, and thus the chamber 171, the flexible tube 167, and the bore 165 provide a vent path that prevents positive pressure from building when the cap is brought into engagement with the ink jet cartridge.

Thus, the ink jet cartridge primer in accordance with the invention seals a capper against (1) the nozzle plate of the ink jet cartridge to be primed or (2) a vacuum convey structure in communication with the nozzle plate of the cartridge to be primed while producing negative pressure at the opening of the capper, produces priming ink suctioning negative pressure, and then unsealing capper from the nozzle plate or the vacuum conveying structure while producing negative pressure at the opening of the capper. In this manner, negative pressure is provided at the nozzle array at all times that the capper is engaged against the nozzle plate or the vacuum conveying structure, which avoids the application or positive or zero pressure by the capper to the cartridge nozzle array.

The foregoing has been a disclosure of an ink jet cartridge primer that applies negative pressure to the nozzles, and thereby advantageously provides ink flow causing force directly to the nozzles where it is needed while avoiding the need for pressurizing access to the ink reservoir.

Although the foregoing has been a description and illustration of specific embodiments of the invention, various modifications and changes thereto can be made by persons skilled in the art without departing from the scope and spirit of the invention as defined by the following claims.

What is claimed is:

1. A method for priming an ink jet cartridge comprising the steps of:

positioning a capper having an opening against the nozzle plate of the ink jet cartridge so that the capper opening surrounds a nozzle array of the nozzle plate;

producing negative pressure at the capper opening while positioning the capper opening against the nozzle plate;

maintaining the capper opening against the nozzle plate;

producing ink suctioning negative pressure at the capper opening while maintaining the capper opening against the nozzle plate;

removing the capper from the nozzle plate of the ink jet cartridge; and producing negative pressure at the capper opening while removing the capper from the nozzle plate of the ink jet cartridge.

2. A method for priming an ink jet cartridge comprising the steps of:

positioning a capper having an opening against a negative pressure conveying means that is configured to convey negative pressure to a nozzle array of the ink jet cartridge;

producing negative pressure at the capper opening while positioning the capper opening against the negative pressure conveying means;

maintaining the capper opening against the negative pressure conveying means;

producing ink suctioning negative pressure at the capper opening while maintaining the capper opening against negative pressure conveying means;

removing the capper from the negative pressure conveying means; and producing negative pressure at the capper opening while removing the capper from the negative pressure conveying means.

3. Primer apparatus for priming an ink-jet cartridge having an array of ink ejecting nozzles, comprising:

an elongated resilient bellows compressible along a length of said elongated resilient bellows and having a first end cap and a second end cap at ends of said resilient bellows, said first end cap having an opening at which at which negative pressure is produced when said first and second end caps are relatively displaced away from each other;

capping means supported by said first end cap of said bellows means for selectively engaging the nozzle array of the cartridge being primed to form a seal therewith so that the negative pressure produced in said opening of said first end cap is communicated to the nozzles of the nozzle array;

first moving means for moving said first end cap to engage said capping means against the cartridge nozzle array and to disengage said capping means from the cartridge nozzle array; and second moving means for moving said second end cap relative to said first end cap such that (a) negative pressure is produced during engagement and disengagement of the capping means and (b) ink suctioning negative pressure is continuously produced while the capping means is engaged against the nozzle array.

4. Primer apparatus for priming an ink-jet cartridge having an array of ink ejecting nozzles, comprising:

an elongated resilient bellows compressible along a length of said elongated resilient bellows and having a first end cap and a second end at ends of said resilient bellows, said first end cap having an opening at which at which negative pressure is produced when said first and second end caps are relatively displaced away from each other;

means for conveying negative pressure to the nozzle array of the cartridge;

capping means supported by said first end cap of said bellows means for selectively engaging said negative pressure conveying means to form a seal therewith so that the negative pressure produced in said opening of said first end cap is communicated to the nozzles of the nozzle array;

first moving means for moving said first end cap to engage said capping means against said means for conveying negative pressure and to disengage said capping means from said means for conveying negative pressure; and second moving means for moving said second end cap relative to said first end cap such that (a) negative pressure is produced during engagement and disengagement of the capping means and (b) ink suctioning negative pressure is continuously produced while the capping means is enraged against said means for conveying negative pressure.

5. The primer apparatus of claim 4 wherein the ink jet cartridge is installed in a printer carriage.

* * * * *